US008923721B2

(12) United States Patent
Manabe

(10) Patent No.: US 8,923,721 B2
(45) Date of Patent: Dec. 30, 2014

(54) IMAGE FORMING SYSTEM AND IMAGE FORMING APPARATUS

(71) Applicant: Konica Minolta, Inc., Tokyo (JP)

(72) Inventor: Kenji Manabe, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 112 days.

(21) Appl. No.: 13/679,534

(22) Filed: Nov. 16, 2012

(65) Prior Publication Data

US 2013/0129372 A1 May 23, 2013

(30) Foreign Application Priority Data

Nov. 22, 2011 (JP) ..... 2011-255465

(51) Int. Cl.
*G03G 15/00* (2006.01)

(52) U.S. Cl.
CPC ..... *G03G 15/50* (2013.01); *G03G 15/5083* (2013.01)
USPC ..... 399/82; 399/262; 347/15

(58) Field of Classification Search
USPC ..... 399/82, 262
See application file for complete search history.

(56) References Cited

U.S. PATENT DOCUMENTS

2008/0184236 A1* 7/2008 Yamauchi et al. ..... 718/100

FOREIGN PATENT DOCUMENTS

| | | | |
|---|---|---|---|
| JP | 07-121318 | | 5/1995 |
| JP | 10187378 | A | 7/1998 |
| JP | 2006268110 | A | 10/2006 |
| JP | 2007-210171 | | 8/2007 |
| JP | 2007-326267 | | 12/2007 |
| JP | 2009-178873 | | 8/2009 |
| JP | 2010-257082 | | 11/2010 |

OTHER PUBLICATIONS

Office Action issued in corresponding counterpart Japanese Patent Application No. JP 2011-255465 on Nov. 6, 2013.
Japanese Office Action dated Jun. 10, 2014 in counterpart Japanese Application No. 2011-255465.

* cited by examiner

*Primary Examiner* — Walter L Lindsay, Jr.
*Assistant Examiner* — Roy Y Yi
(74) *Attorney, Agent, or Firm* — Holtz, Holtz, Goodman & Chick PC

(57) ABSTRACT

Disclosed is an image processing apparatus including: a control unit; an image forming unit; a storing unit; and a job reception unit, wherein in case that the control unit identifies that the print job received while the job reception unit receives the print job group is another print job received from another external device in accordance with the identification information, the control unit controls the storing unit so as to hold the another print job until the image forming unit completes the image forming in accordance with the print job group, and after the image forming unit completes the image forming in accordance with the print job group, the control unit controls the image forming unit so as to start the image forming in accordance with the another print job.

16 Claims, 15 Drawing Sheets

| SENDER | STATE |
|---|---|
| USER A | PRINTING |
| USER A | PRINT WAITING |
| USER B | PRINT WAITING |
| USER A | PRINT WAITING |
| USER A | PRINT WAITING |
| USER A | PRINT WAITING |

IMAGE FORMING SYSTEM AND IMAGE FORMING APPARATUS

BACKGROUND OF THE INVENTION

1. Field of the Invention

The present invention relates to an image forming system and an image forming apparatus, for forming an image in accordance with a received job.

2. Description of Related Art

An image forming apparatus, such as a multi-function peripheral, has a print function for printing an image on recording paper in accordance with a job received from a personal computer (PC). In case a plurality of jobs are received by the image forming apparatus, the image forming apparatus temporarily holds the jobs in a RAM (Random Access Memory) and prints an image on the recording paper by executing the held jobs sequentially.

In Japanese Patent Application Publication No 2007-210171, the following image forming apparatus is disclosed. In the image forming apparatus, while a specific print job is executed in the execution order which is previously set, a user operates a priority print key. Thereby, the specific print, job is stopped and another print job is preferentially executed.

Japanese Patent Application Publication No. 2007-326267 discloses an image forming apparatus in which the print jobs can be held with respect to each user and the user can designate the jobs to be successively executed. Therefore, the user can consciously instruct the image forming apparatus to execute the jobs successively to a certain extent.

For example, in a file prepared by a spreadsheet software (hereinafter, referred to as "spreadsheet file"), there are a plurality of sheets. In case that the plurality of sheets are collectively printed, the user sets the "print what" to a plurality of sheets (for example, "Active sheet(s)" or "Entire workbook") by using a printer driver and transmits the print job to the image forming apparatus.

At this time, despite the user's intention, the print job is divided into a plurality of jobs and each of the plurality of jobs is transmitted to the image forming apparatus at an irregular time interval. When another user transmits a print job to the image forming apparatus during the irregular time interval, the print job transmitted by another user is inserted into the plurality of jobs. As a result, there was a problem that the printed document of one user is mixed with that of another user.

However, in the above Patent Application Publications, the specific means for solving the above problem are not disclosed. In particular, in case of the image forming apparatus disclosed in Japanese Patent Application Publication No. 2007-326267, the user can consciously set the image forming apparatus so as to execute the jobs successively to a certain extent. On the other hand, when a plurality of sheets of a spreadsheet file are collectively printed, the user hardly recognizes that a print job is divided into a plurality of jobs. Therefore, the user hardly sets the image forming apparatus consciously so as to execute the jobs successively to a certain extent.

Further, in the above Patent Application Publications, the technology for holding a plurality of jobs in a RAN or the like of the image forming apparatus is disclosed. The above problem is caused by transmitting a plurality of jobs into which a print job is divided, to the image forming apparatus at the irregular time interval. Therefore, even though a plurality of jobs are not necessarily held in the image forming apparatus, the above problem is possibly caused. In the Patent Application Publications, the above problem could not be solved.

SUMMARY

To achieve at least one of the abovementioned objects, an image forming system reflecting one aspect of the present invention comprises: an external device to transmit a print job to an image forming apparatus; and the image forming apparatus to execute an image forming in accordance with the print job, wherein the external device comprises:

a tag attaching unit to attach a tag having identification information to a print job group having two or more division jobs generated by dividing one print job in case that the print job to be transmitted is the print job group, the identification information requesting the image forming apparatus which receives the division jobs constituting the print job group, to identify that the transmitted print job is the division job, and a job transmission unit to transmit the print job group;

wherein the image forming apparatus comprises:

a control unit, an image forming unit to execute the image forming in accordance with the print job group, a storing unit to hold one or more print jobs, and a job reception unit to receive the print job group from the external device;

wherein the job reception unit receives the tag, and in case that in accordance with the identification information included in the tag, the control unit identifies that the print job received while the job reception unit receives the print job group is another print job received from another external device except the external device which transmits the print job group, the control unit controls the storing unit so as to hold the another print job until the image forming unit completes the image forming in accordance with the print job group, and after the image forming unit completes the image forming in accordance with the print job group, the control unit controls the image forming unit so as to start the image forming in accordance with the another print job.

Preferably, the tag comprises a first tag which is attached to a first division job which is received by the job reception unit initially in the print job group, and a second tag which is attached to a last division job which is received by the job reception unit last in the print job group.

Preferably, the tag is attached to a first division job which is received by the job reception unit initially in the print job group, and the identification information includes one selected from among the number of the division jobs constituting the print job group, a total data size of the print job group, and the number of total pages of image data included in the print job group.

Preferably, the tag is attached to a last division job which is received by the job reception unit last in the print job group, and the tag attaching unit attaches another tag having another identification information to a print job except the division job, the another identification information requesting the image forming apparatus to identify that the print job except the division job is not the division job.

Preferably, in case that the job reception unit receives the print job group for forming images of a plurality of pages on one sheet, from the external device, the control unit controls the image forming unit so as to start the image forming on the one sheet after the job reception unit receives image data of the plurality of pages, for forming the images of the plurality of pages on the one sheet.

Preferably, the identification information included in the first tag attached to the first division job, includes receiving time estimation information for estimating receiving time required for the job reception unit to receive the print job group, after the job reception unit receives the first tag attached to the first division job, the control unit determines timing at which the image forming unit starts the image forming of an initial page in accordance with the print job group, based on the receiving time estimation information.

Preferably, the image forming system further comprises a display unit, wherein when the job reception unit receives the another print job while the image forming unit executes the image forming in accordance with the print job group, the control unit instructs the display unit to display an inquiry to determine whether to execute the image forming in accordance with the another print job by interrupting the image forming executed in accordance with the print job group during execution of the image forming in accordance with the print job group.

Preferably, the control unit estimates the time required to execute the image forming in accordance with the another print job, and when the control unit judges that the estimated time is not more than a threshold value, the control unit instructs the display unit to display the inquiry to determine whether to execute the image forming in accordance with the another print job by interrupting the image forming executed in accordance with the print job group.

Preferably, in case that the display unit is in a power saving mode, when the job reception unit receives the another print job while the image forming unit executes the image forming in accordance with the print job group, the control unit wakes the display unit from the power saving mode and instructs the display unit to display information relating to the print jobs which are received by the job reception unit.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein.

DETAILED DESCRIPTION OF PREFERRED EMBODIMENTS

Hereinafter, a preferred embodiment of the present invention will be explained with reference to the accompanying drawings.

Figure 1:
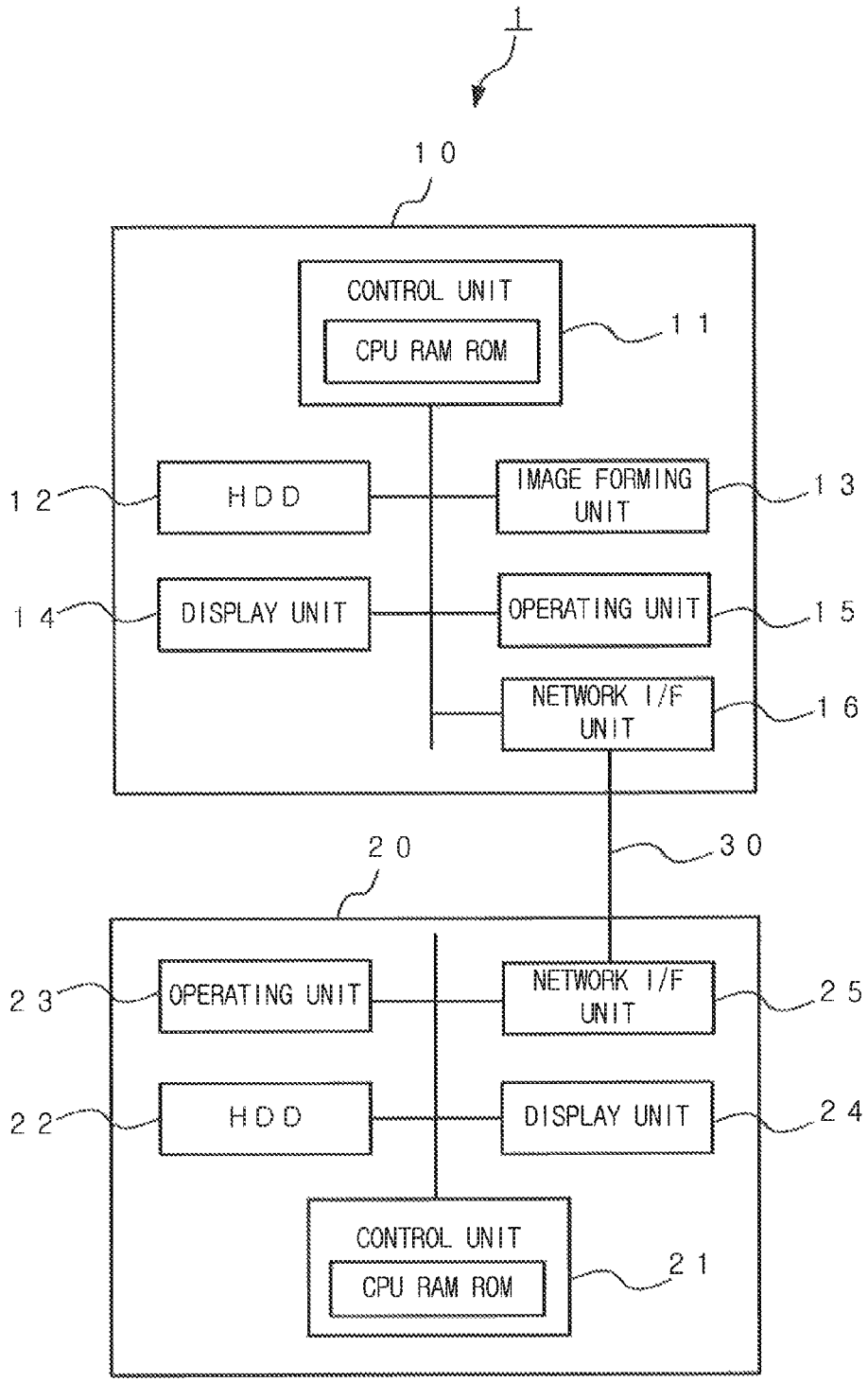
FIG. 1 is a block diagram showing a schematic configuration of the image forming system according to the embodiment.

FIG. 1 is a block diagram showing the schematic configuration of the image forming system 1 according to the embodiment.

The image forming system 1 comprises an image forming apparatus 10 and an external device 20.

The image forming apparatus 10 receives print jobs from the external device 20 via a network 30, such as LAN (Local Area Network), and executes the print of the images in accordance with these print jobs.

The image forming apparatus 10 comprises a control unit 11 for controlling the whole operation of the image forming apparatus 10, an HDD (Hard Disk Drive) 12, an image forming unit 13, a display unit 14, an operating unit 15 and a network I/F (interface) unit 16.

The control unit 11 comprises a CPU (Central Processing Unit), a ROM (Read Only Memory), a RAM (Random Access Memory) and the like as main units. By executing the process in accordance with various programs stored in the ROM, various functions of the image forming apparatus 10 are realized.

The control unit 11 instructs the image forming unit 13 to execute the print of an image in accordance with a print job received from the external device 20.

Further, the control unit 11 identifies whether the print job received while the print job group is received from the external device 20 which will be explained below, is one print job of the print job group in accordance with the identification information included in the tag attached to the above print job group. In case that the control unit 11 identifies that the received print job is another print job received from another external device 20, the control unit 11 controls the RAN and the like so as to hold another print job until the image forming unit 13 completes the print of the images in accordance with the print job group. After the image forming unit 13 completes the print of the images in accordance with the print job group, the control unit 11 controls the image forming unit 13 so as to start the print of the image in accordance another print job.

The HDD 12 stores various types of saved data and various types of input data. In the HDD 12, the received print jobs are stored as necessary.

The image forming unit 13 is configured as the laser type of printer engine for forming an image on recording paper by the electro photographic process. The printer engine comprises a conveying device for the recording paper, a photoconductive drum, a charging device, a laser unit, a developing device, a transfer and separation device, a cleaning device and a fixing device. The image forming unit 13 mainly prints out the image in accordance with the print job received from the external device 20.

The display unit 14 is configured by a liquid crystal display (LCD) or the like, and has a function to display the various operation windows, setting windows and the like. Further, the display unit 14 displays a list of the print jobs received from the external device 20 and various messages for users.

The operating unit 15 comprises various types of buttons, such as a start button, a stop button, a numerical keypad and the like, and a touch panel which is provided on the screen of the display unit 14. The touch panel detects a coordinate position in which the user pushes down. The operating unit 15 receives various types of operations for the image forming apparatus 10 from the users.

The network I/F unit 16 has a function as an interface for communicating with the external device 20 and the like via the network. The network I/F unit 16 has a main function as the job reception unit for receiving the print job from the external device 20.

The external device 20 is, for example, a PC (Personal Computer) or the like, and is used for inputting a print job and transmits the input print job to the image forming apparatus 10. The external device 20 comprises a control unit 21, an HDD 22, an operating unit 23, a display unit 24 and a network I/F unit 25.

The control unit 21 comprises a CPU, a ROM, a RAM and the like as main units. By executing the process in accordance with various programs stored in the ROM, various functions of the external device 20 are realized.

Further, the control unit 21 judges whether a job to be transmitted to the image forming apparatus 10 is a print job for collectively printing a plurality of sheets of the spreadsheet file (hereinafter, referred to as "spreadsheet file print job") or not. When the external device 20 transmits the spreadsheet file print job to the image forming apparatus 10, the spreadsheet file print job is divided into a plurality of print jobs (hereinafter, referred to as also "division file") by the spreadsheet software. Then, the print jobs are transmitted to the image forming apparatus 10 as a print job group which is composed of the division files. At this time, in case that the control unit 21 judges that the above job is the spreadsheet file print job, the control unit 21 attaches a tag which will be described, to the print job group when the spreadsheet file print job is transmitted.

The HDD 22 stores various types of saved data and various types of input data. In the HDD 22, the user information which is attached to the print job when the print job is transmitted to the image forming apparatus 10, is stored.

The operating unit 23 comprises a keyboard, a mouse and the like. The operating unit 23 mainly receives the input of the necessary print setting condition, such as the setting of the print job or the like.

The display unit 24 is configured by a liquid crystal display or the like, and has a function to display the various operation windows, setting windows and the like.

The network I/F unit 25 has a function as an interface for communicating with the image forming apparatus 10 and the like via the network. The network I/F unit 25 has a main function as the job transmission unit for transmitting the print job to the image forming apparatus 10.

Next, the problem caused by collectively printing a plurality of sheets of the spreadsheet file will be explained.

Figure 2A:
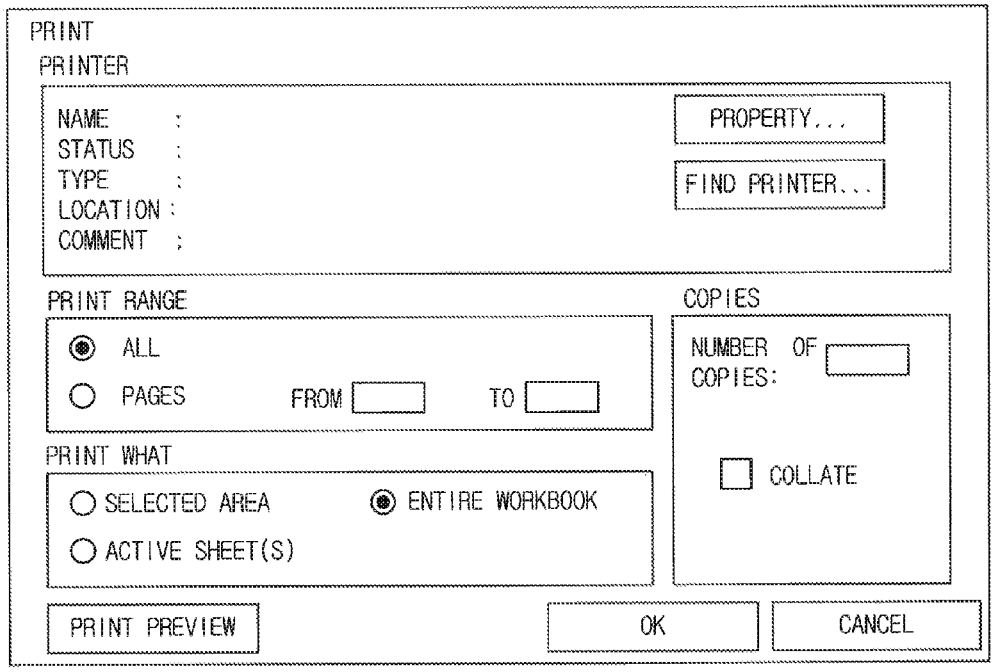
FIG. 2A is a view showing an example of the setting window for a printer driver, which is displayed on a display unit of an external device.
Figure 2B:
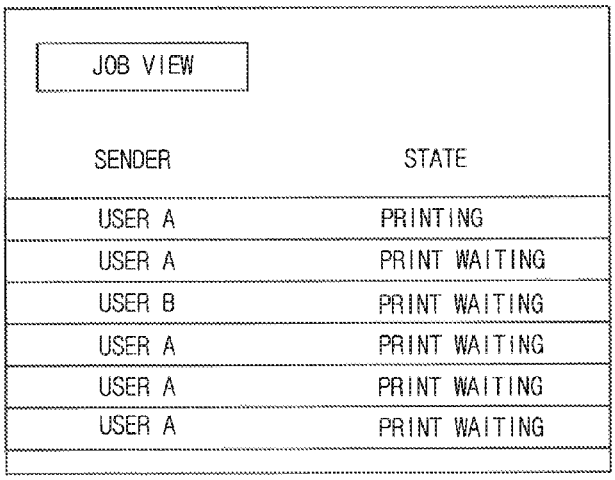
FIG. 2B is a view showing an example of a list of the received print jobs, which is displayed on the display unit of the image forming apparatus.
Figure 3:
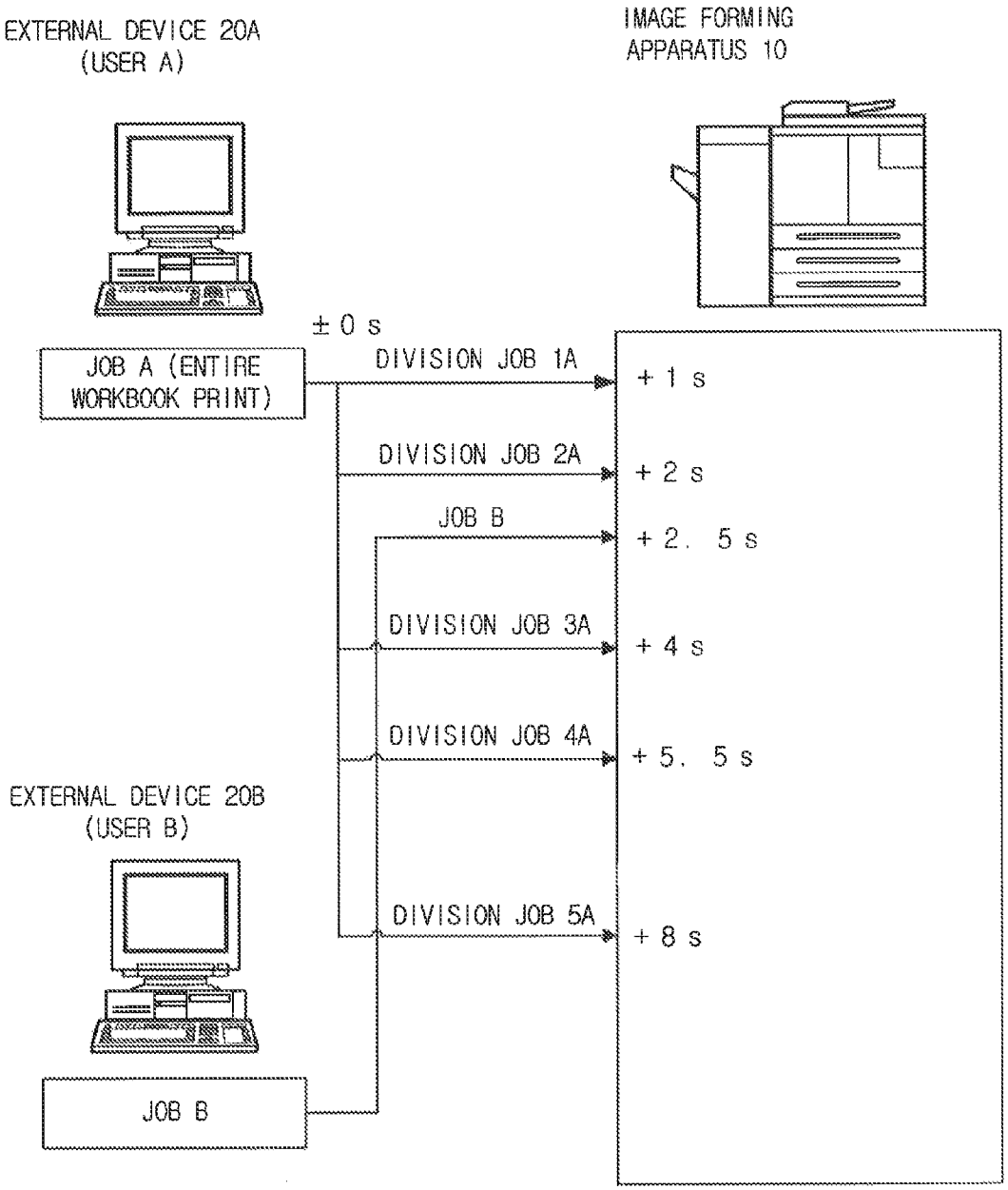
FIG. 3 is an explanatory view showing the mixing state of the jobs, which is caused in case that the image forming apparatus receives another print job from another external device when the image forming apparatus receives the print job group.

FIG. 2A is a view showing an example of the setting window for a printer driver, which is displayed on the display unit 24 of the external device 20. FIG. 2B is a view showing an example of a list of the received print jobs, which is displayed on the display unit 14 of the image forming apparatus 10. FIG. 3 is an explanatory view showing the mixing state of the jobs, which is caused in case that the image forming apparatus 10 receives another print job from another external device 20 when the image forming apparatus 10 receives the print job group.

When the user A prints a plurality of sheets of the spreadsheet file, the user A opens the setting window for the printer driver, which is shown in FIG. 2A and selects "Entire workbook" or "Active sheet(s)" as the sheets to be printed. After the user A inputs the other condition settings into the setting window, the user A instructs the transmission of the print job to the image forming apparatus 10 by clicking the OK button.

At this time, the above print job is divided into a plurality of jobs despite the user's intention. Each of the division jobs is transmitted to the image forming apparatus 10 at an irregular time interval. In case of the example shown in FIG. 3, when the print job A for printing a plurality of sheets is transmitted from the external device 20A of the user A to the image forming apparatus 10, the print job A is divided into the division jobs 1A to 5A. The division jobs 1A to 5A constitute the print job group, and are transmitted to the image forming apparatus 10 at an irregular time interval from 1 second to 2.5 seconds.

In the example shown in FIG. 3, when the print job B is transmitted from the external device 20B of the user B since the transmission of the division job 2A until the transmission of the division job 3A, the print job B is inserted between the division job 2A and the division job 3A. Therefore, as shown in FIG. 2B, in the list of the print jobs displayed on the display unit 14 of the image forming apparatus 10, the print job B is displayed so as to be inserted between a plurality of division jobs. As a result, the printed document of the user A is mixed with that of the user B.

Next, the process for avoiding the mixture of the printed documents according to the embodiment will be explained.

Figure 4:
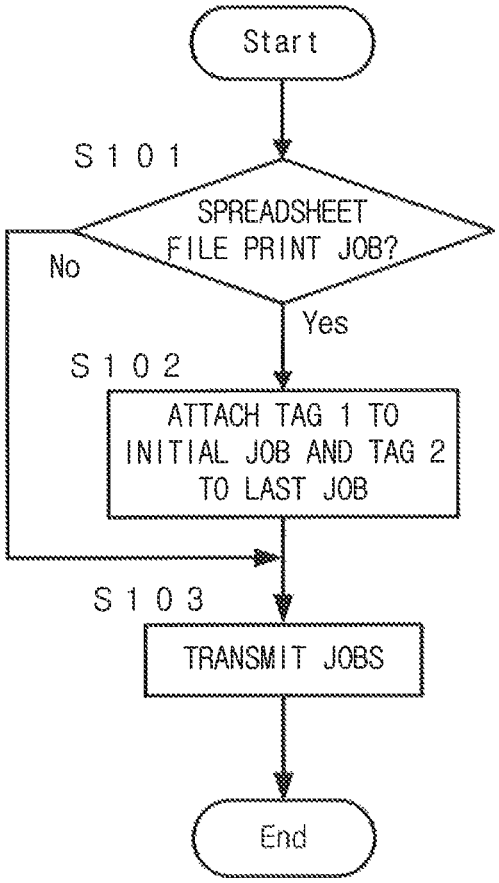
FIG. 4 is a flowchart showing a process in which the external device attaches a tag having identification information for identifying whether a print job is one job of the print job group by the image forming apparatus, to the print job group.
Figure 5:
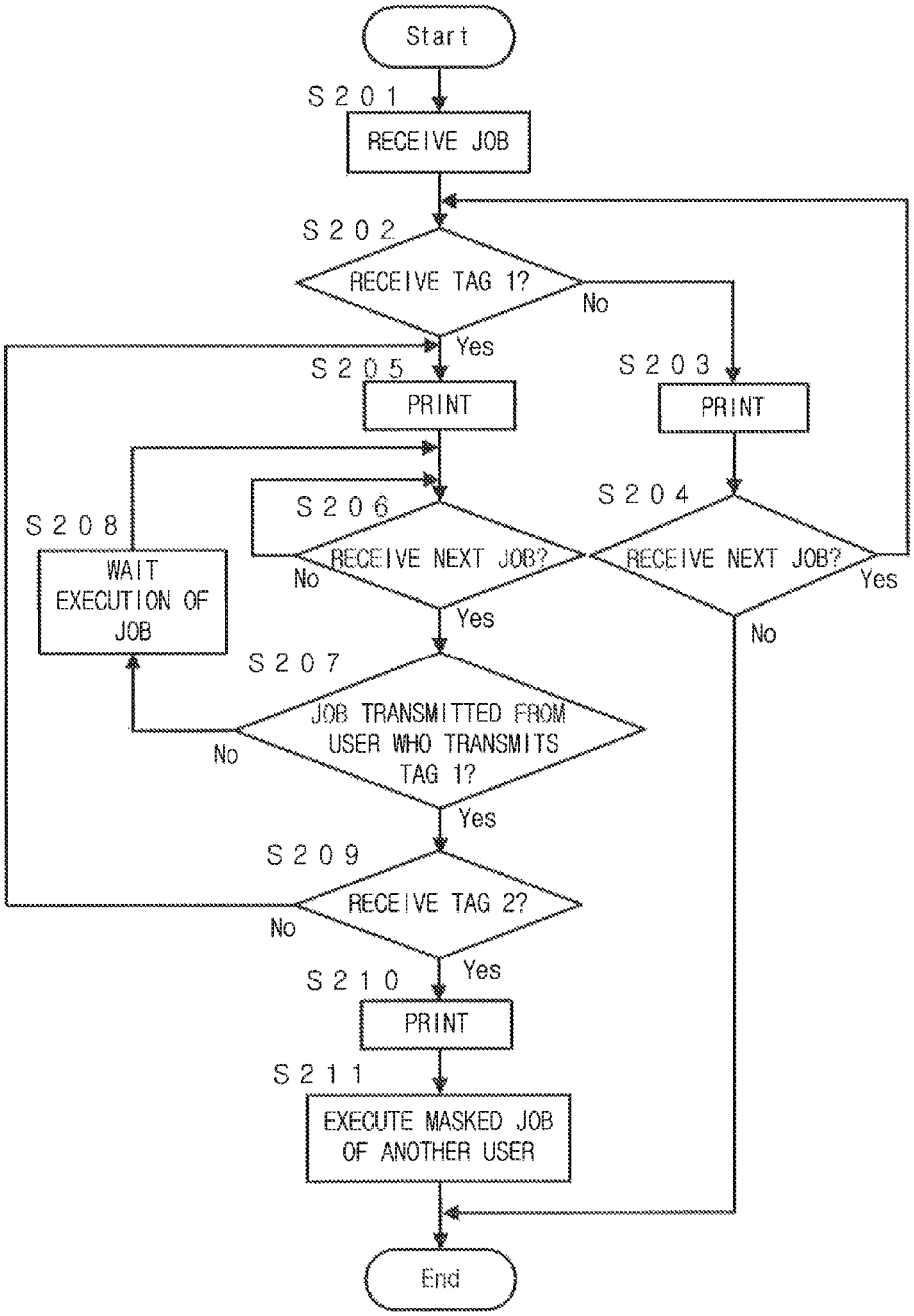
FIG. 5 is a flowchart showing a process in which the image forming apparatus identifies the received print job and in case that the image forming apparatus identifies that the received print job is a print job received from another external device, the image forming apparatus waits the execution of the received print job until the image forming apparatus completes the print of images in accordance with the print job group.
Figure 6:
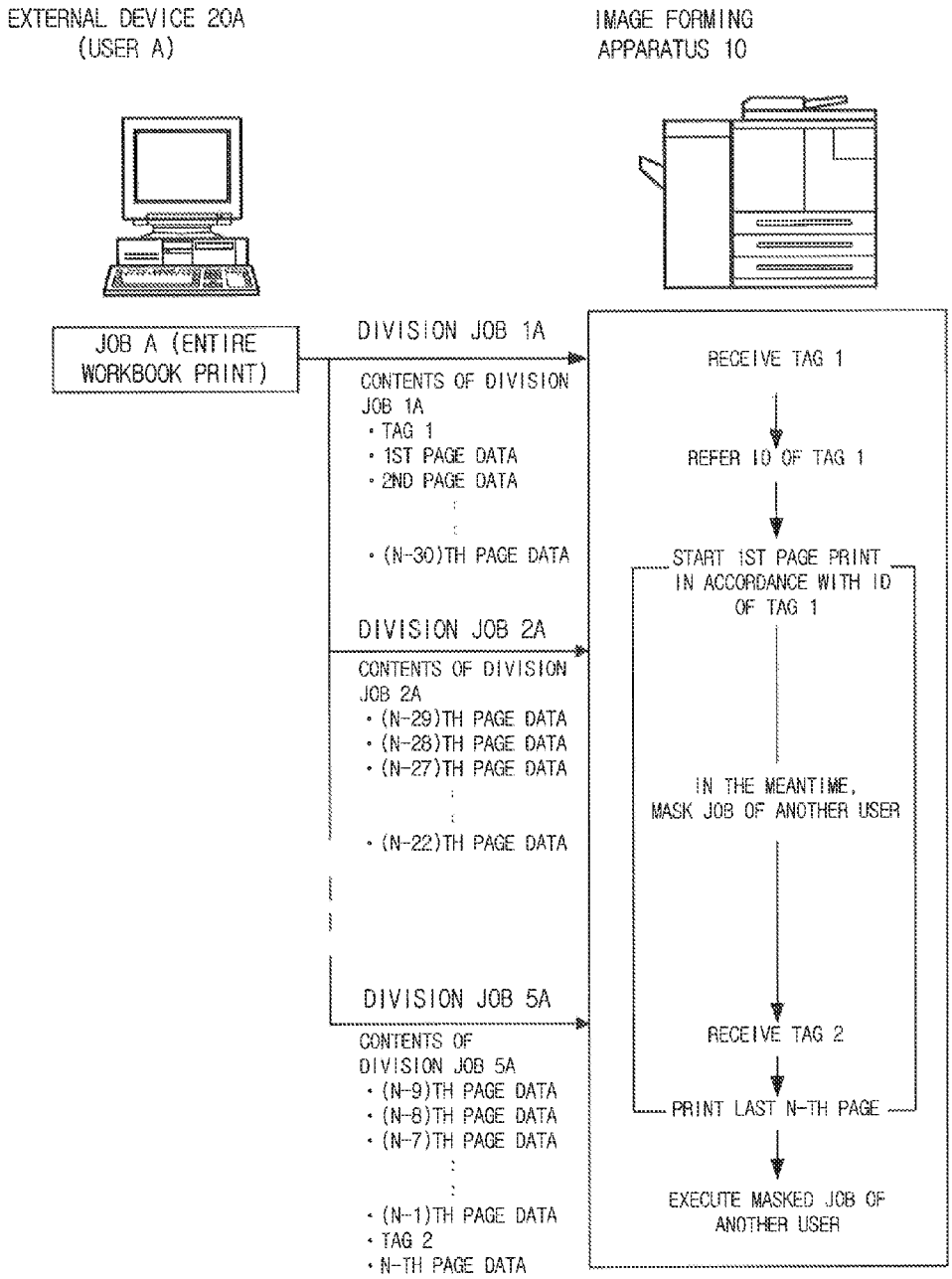
FIG. 6 is an explanatory view which schematically shows the processes shown in FIG. 4 and FIG. 5.

FIG. 4 is a flowchart showing the process in which the external device 20 attaches the tag to the above print job group. FIG. 5 is a flowchart showing the operation of the image forming apparatus 10 which receives the print job. FIG. 6 is an explanatory view which schematically shows the processes shown in FIG. 4 and FIG. 5.

The control unit 21 of the external device 20 judges whether the print job to be transmitted to the image forming apparatus 10 is the spreadsheet file print job or not (Step S101).

In case that the control unit 21 judges that the print job to be transmitted is the spreadsheet file print job (Step S101; Yes), when the print job group is generated by dividing the spreadsheet file print job, the control unit 21 attaches the tag 1 to the print job which is initially transmitted in the print job group and attaches the tag 2 to the print job which is last transmitted in the print job group, respectively (Step S102). In the example of FIG. 6, the spreadsheet file print job is divided into five division jobs 1A to 5A and the five division jobs constitute the print job group. The tag 1 may be attached to the print job which is initially transmitted in the print job group. However, in consideration of the timing at which the image forming apparatus 10 starts to print the document, it is preferable that the control unit 21 attaches the tag 1 to the data of the first page in the division job 1A as shown in the example of FIG. 6. The tag 2 may be attached to the print job which is last transmitted in the print job group. In the example of FIG. 6, the control unit 21 attaches the tag 2 to the data of the nth page (last page) in the division job 5A.

These two tags include the identification information for identifying whether the job received by the image forming apparatus 10 is the print job (division job) of the print job group or not. In this example, as the identification information, at least the user information and the IP (Internet Protocol) address of the external device 20 which transmits the above print job group are included. Further, the identification information of the tag 1 includes the information indicating that the print job to which the tag 1 is attached is the initial job of the print job group, and the like. The identification information of the tag 2 includes the information indicating that the print job to which the tag 2 is attached is the last job of the print job group, and the like.

Then, the control unit 21 transmits the print job group to the image forming apparatus 10 via the network I/F unit 25 (Step S103). The operation of the external device 20 is ended.

On the other hand, in case that the control unit 21 judges that the print job to be transmitted is not the spreadsheet file print job (Step S101; No), the control unit 21 transmits the print job to the image forming apparatus 10 via the network I/F unit 25 without attaching the above tag to the print job (Step S103). Further, in case that a spreadsheet file print job is not divided, the control unit 21 does not attach the tags to the job. Then, the operation of the external device 20 is ended.

The image forming apparatus 10 receives the print job which is transmitted from the external device 20 (Step S201).

When the image forming apparatus 10 receives the print job from the external device 20 via the network I/F unit 16, the control unit 11 judges whether the tag 1 is attached to the print job, that is, the tag 1 is received or not (Step S202).

When the control unit 11 judges that the image forming apparatus 10 does not receive the tag 1 (Step S202; No), the image forming unit 13 executes the print of the image in accordance with the received print job (Step S203). At this time, the control unit 11 judges that the print job is not a division job. Then, the control unit 11 judges whether a next print job is received (Step S204). When the control unit 11 judges that the next print job is not received (Step S204; No), the operation of the image forming apparatus 10 is ended. On the other hand, when the control unit 11 judges that the next print job is received (Step S204; Yes), the process returns to Step S202.

When the control unit 11 judges that the image forming apparatus 10 receives the tag 1 (Step S202; Yes), the image forming unit 13 executes the print of the image in accordance with the received print job (Step S205). At this time, the control unit 11 judges that the received print job is the initial print job of the print job group (division job 1A in FIG. 6). Then, the control unit 11 monitors the reception of the next print job (Step S206; No).

When the control unit 11 judges that the image forming apparatus 10 receives the next print job (Step S206; Yes), the control unit 11 judges whether the user (external device 20) who transmits the received print job is the same as the user (external device 20) who transmits the print job group in view of the identification information included in the tag 1, for example, the user information and the IP address of the external device 20 which transmits the print job group, and the like (Step S207).

When the control unit 11 judges that the user who transmits the received print job is not the same as the user who transmits the above print job group (Step S207; No), the control unit 11 judges that the received print job is not the job (division job in FIG. 6) of the above print job group. Further, the control unit 11 waits the execution of the print job by temporarily holding the print job in the RAM of the control unit 11 or the HDD 12, such as by masking the print job (Step S208). Then, the control unit 11 monitors the reception of the net print job again (Step S206; No).

On the other hand, when the control unit 11 judges that the user who transmits the received print job is the same as the user who transmits the above print job group (Step S207; Yes), the control unit 11 judges that this print job is the division job and judges whether the tag 2 is attached to this print job (Step S209).

When the control unit 11 judges that the tag 2 is not attached to this print job (division job) (Step S209; No), the image forming unit 13 executes the print of the image in accordance with this job (Step S205). At this time, the control unit 11 judges that the image forming apparatus 10 does not complete the reception of the last division job (division job 5A in FIG. 6). The control unit 11 monitors the reception of the next print job again (Step S206; No).

On the other hand, when the control unit 11 judges that the tag 2 is attached to this print job (division job) (Step S209; Yes), the image forming unit 13 executes the print of the image in accordance with this job (Step S210). At this time, the control unit 11 judges that this division job is the last job of the print job group and that the image forming apparatus 10 receives all of the division jobs. After the image forming unit 13 completes the print of the image in accordance with the last division job 5A, the control unit 11 executes another print job received from another user, which is held in the RAM of the control unit 11 or the like by masking another print job (Step S211). Then, the operation of the image forming apparatus 10 is ended.

Next, the operation of the image forming apparatus 10 will be explained in case that the images of a plurality of pages are printed on one sheet, that is, in case that the page allocation print, such as 4in1, is set.

Figure 7:
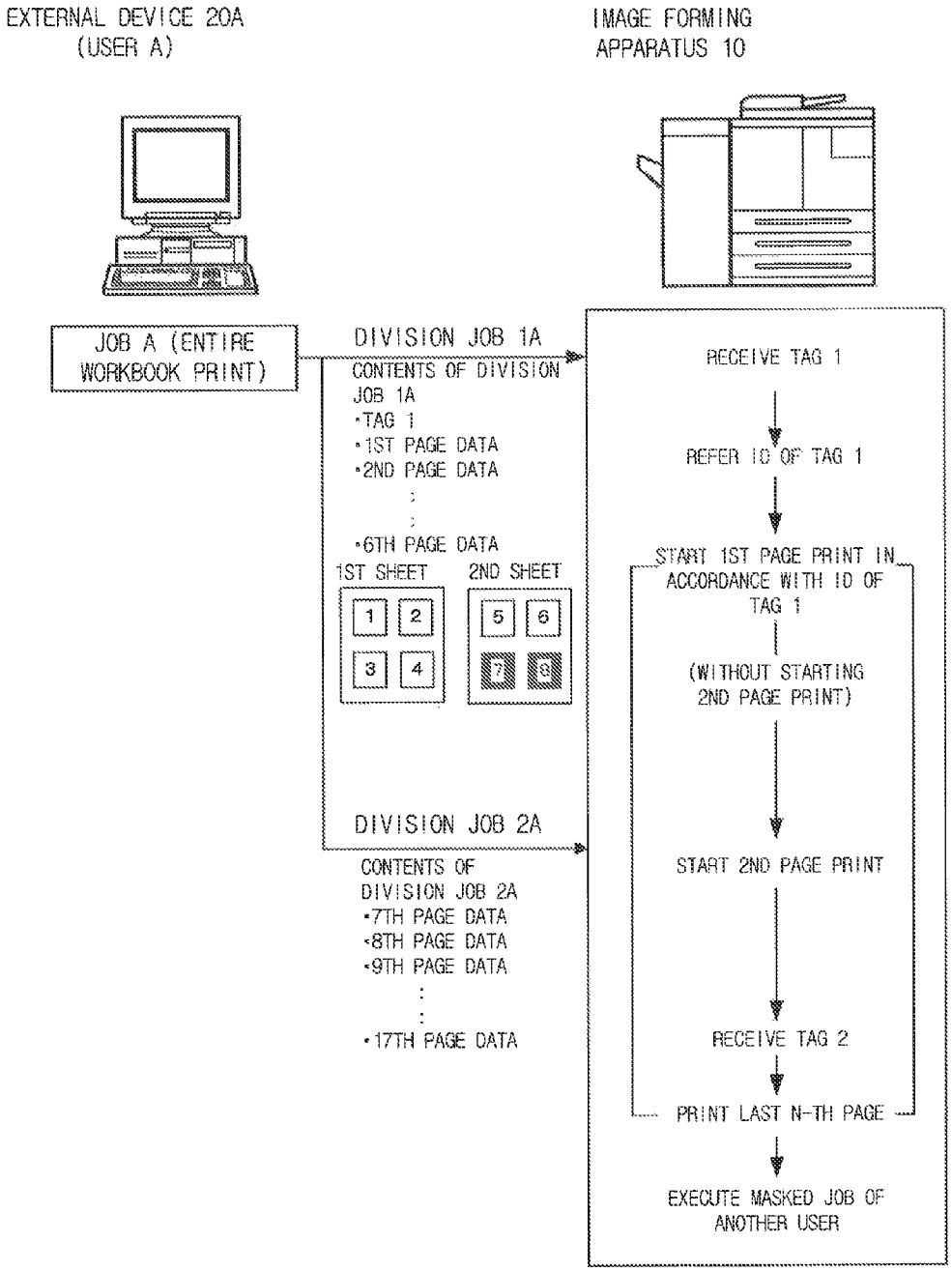
FIG. 7 is an explanatory view which schematically shows the operation of the image forming apparatus in case that the page allocation print is set.

FIG. 7 is an explanatory view which schematically shows the operation of the image forming apparatus 10 in case that the page allocation print is set. In this embodiment, the operation of the image forming apparatus 10 will be explained in case that the images of four pages are printed in one sheet, that is, in case of 4in1.

When the spreadsheet file print job in which the page allocation print is set is transmitted from the external device 20, this spreadsheet file print job is divided into a plurality of print jobs as described above. The control unit 21 attaches the tag 1 to the initial print job (division job 1A) of a plurality of print jobs (print job group) and the tag 2 to the last print job, respectively.

In this case, in the division job 1A, the image data of six pages are included. In the division job 2A, the image data of seventh page and subsequent pages are included.

When the image forming apparatus 10 receives these division jobs, the image forming apparatus 10 prints the images in accordance with the print job group while the image forming apparatus 10 waits the execution of another print job received from another user in accordance with the identification information included in the tag 1 as described above.

However, if the image forming apparatus 10 prints the images in accordance with the received division job 1A before the image forming apparatus 10 receives the division job 2A, the image forming unit 13 prints only the images of fifth and sixth pages on the second sheet.

Therefore, the image forming apparatus 10 starts the print of the images on the second sheet after the image forming apparatus 10 receives the image data of four pages for printing images of the four pages on the second sheet, that is, after the image forming apparatus 10 receives the division job 2A including the image data of the seventh and eighth pages, for printing the images of the seventh and eighth pages on the second sheet. Further, in case that the image forming apparatus 10 receives the last division job of the print job group, the image forming apparatus 10 starts the print of the image of the last page even though the image forming apparatus 10 does not receive the image data of four pages for printing the images on the sheet used for printing the image of the last page.

Thereby, the image forming apparatus 10 can prevent the images from being printed on the second sheet before the image forming apparatus 10 receives the image data of the seventh and eighth pages, for printing the images on the second sheet.

Next, in case that the image forming apparatus 10 receives the print job group, the timing at which the image forming apparatus 10 starts the print of the images in accordance with the print job group, will be explained.

Figure 8:
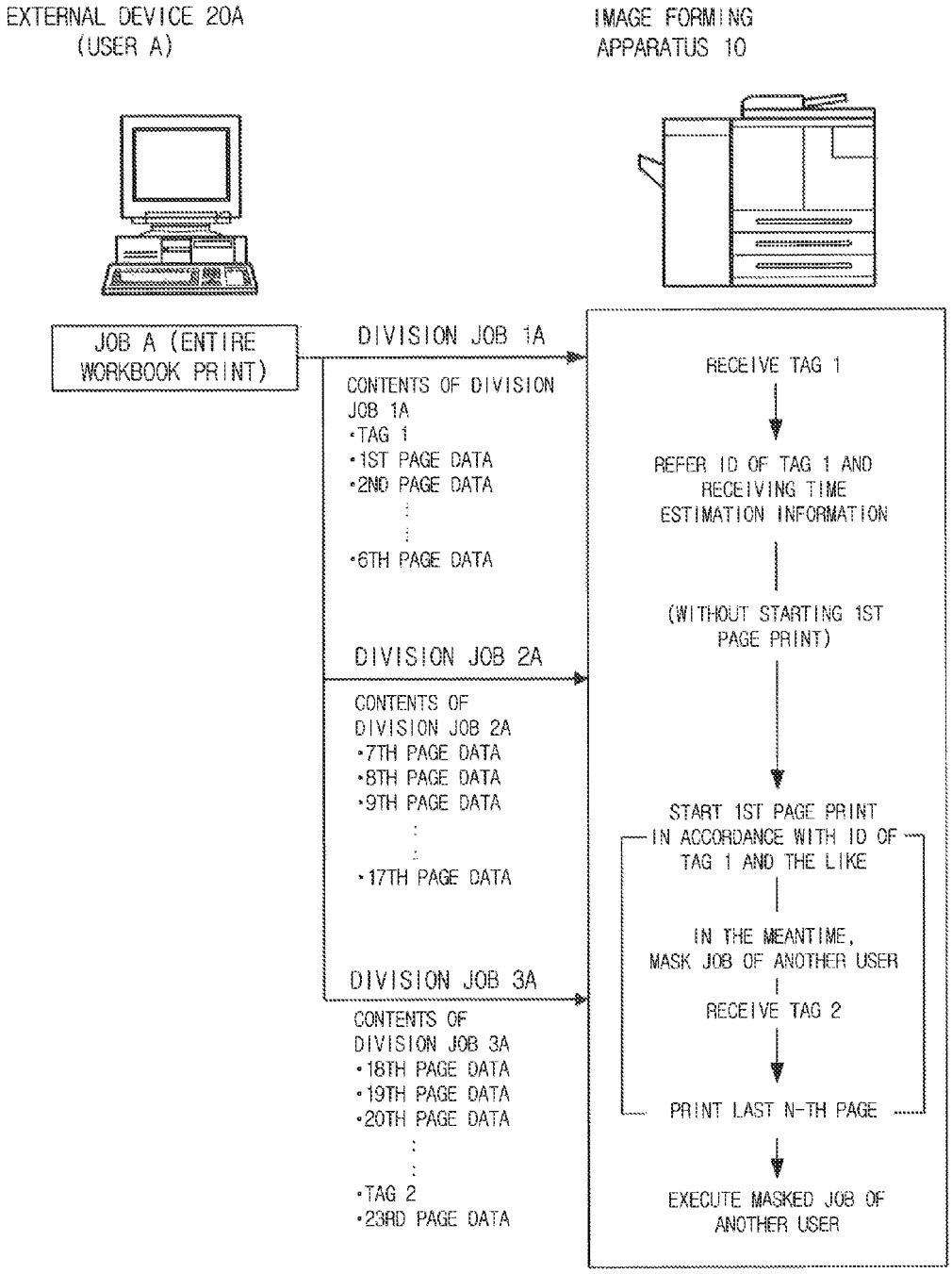
FIG. 8 is an explanatory view which schematically shows the process for determining the timing at which the image forming apparatus starts the print of images in accordance with the print job group.

FIG. 8 is an explanatory view which schematically shows the process for determining the timing at which the image forming apparatus 10 starts the print of the images in accordance with the print job group.

In the present example, when the spreadsheet file print job is transmitted from the external device 20, the spreadsheet file print job is divided into the division jobs 1A to 3A. The control unit 21 attaches the tag 1 to the initial print job (division job 1A) of a plurality of division jobs (print job group) and the tag 2 to the last print job (division job 3A), respectively.

When the image forming apparatus 10 receives the division job 1A, the image forming apparatus 10 prints the images in accordance with the division jobs 1A to 3A while the image forming apparatus 10 waits the execution of another print job received from another user in accordance with the identification information included in the tag 1 as described above.

However, because each of the division jobs is transmitted to the image forming apparatus 10 at an irregular time interval as described above, when the image forming apparatus 10 prints the images in accordance with the division job 1A immediately after receiving the division job 1A, the waiting time for receiving the subsequent print jobs which are the division jobs 2A and 3A is likely caused for the irregular time interval.

When the external device 20 attaches the tag 1 to the division job 1A, the external device 20 incorporates the receiving time estimation information for estimating the receiving time required for the image forming apparatus 10 to receive the print job group composed of a plurality of the division jobs, into the identification information. The receiving time estimation information may be the information for estimating the time for receiving the print job group by the control unit 11 of the image forming apparatus 10, for example, the number of the division jobs constituting the print job group (in the example of FIG. 8, three), the total data size of the print job group, the number of the total pages of the images to be printed (in the example of FIG. 8, 23 pages) and the like.

When the control unit 11 receives the identification information of the tag 1, the control unit 11 estimates the receiving time of the print job group in accordance with the receiving time estimation information included in the identification information, the reception interval between the division jobs which were received in the past, and the like. Then, the control unit 11 determines the timing for starting the print of the image in accordance with the division job 1A, that is, the print of the image of the first page so as to adjust the timing at which the print of the all images in accordance with the print job group is completed, to the timing of completing the reception of the print job group.

Thereby, it is possible to shorten the time for occupying the image forming apparatus 10 to print, the images in accordance with the above print job group. Therefore, even in case that the image forming apparatus 10 receives another print job B while the image forming apparatus 10 receives the print job group (division jobs 1A to 5A), it is possible to preferentially execute the print of the image in accordance with the print job B without waiting until the print of the images in accordance with the above print job group is completed, if the image forming apparatus 10 receives the print job B before the timing of starting the print of the image of the first page, which is determined in accordance with the estimated receiving time and the timing at which the print, of the image in accordance with the print job B is completed is earlier than the above timing of starting the print of the image of the first page. Further, because the actuating time of the image forming unit 13 is shortened, it is possible to contribute the power saving.

Next, the operation in which while the image forming apparatus 10 executes the print of the images in accordance with the print job group, the external device 20 of anther user transmits the print job to the image forming apparatus 10 and the image forming apparatus 10 executes the print job received from the external device 20 of anther user by interrupting the print of the images in accordance with the print job group, will be explained.

Figure 9:
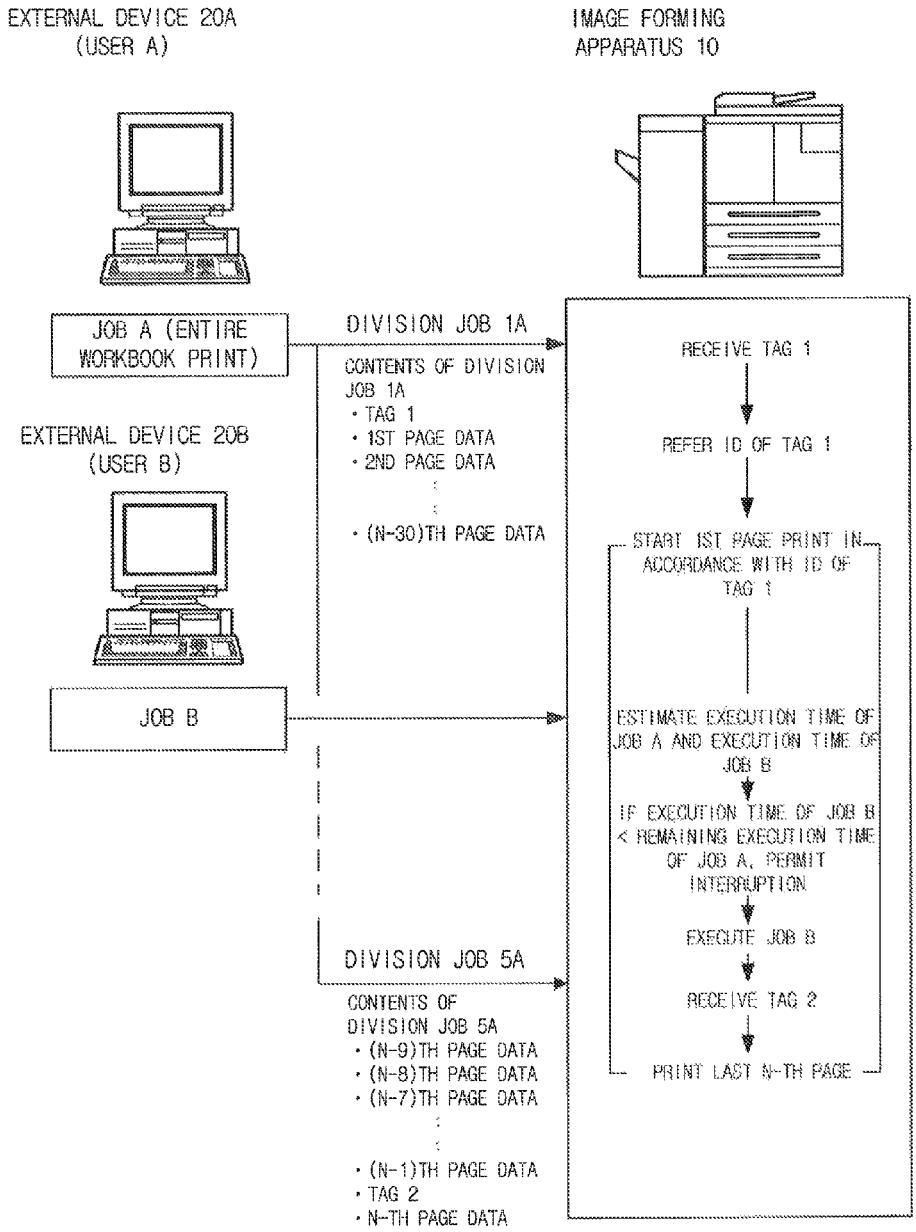
FIG. 9 is an explanatory view which schematically shows a series of operation for executing the print of the image in accordance with the print job received from another user's external device by interrupting the execution of the print of the images in accordance with the print job group.
Figure 10:
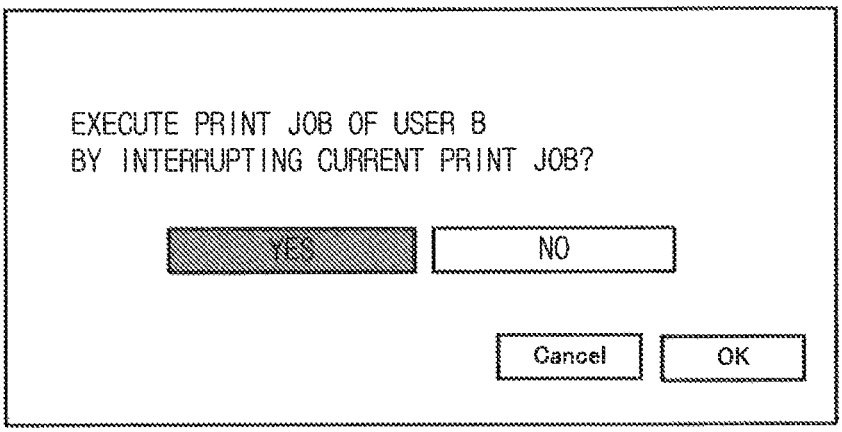
FIG. 10 is a view showing an example of the window for receiving the execution of the print of the image in accordance with the print job received from another user's external device by interrupting the execution of the print of the images in accordance with the print job group, the window being displayed on the display unit of the image forming apparatus.

FIG. 9 is an explanatory view which schematically shows a series of operation for executing the print of the image in accordance with the print job received from the external device 20B of another user by interrupting the execution of the print of the images in accordance with the print job group. FIG. 10 is a view showing an example of the window for receiving the execution of the print of the image in accordance with the print job B received from the external device 20B of another user by interrupting the execution of the print of the images in accordance with the print job group. The above window is displayed on the display unit 14 of the image forming apparatus 10.

In the example, the spreadsheet file print job transmitted from the external device 20A of the user A is divided into the division jobs 1A to 5A. The control unit 21 attaches the tag 1 to the initial print job (division job 1A) of a plurality of print, jobs (print job group), and the tag 2 to the last print job (division job 5A), respectively. Further, the image forming apparatus 10 receives the print job B from the external device 20B of the user B since the image forming apparatus 10 executes the print of the images in accordance with the division job 1A until the image forming apparatus 10 receives the division job 5A.

At this time, the control unit 11 of the image forming apparatus 10 estimates the time required to print, the images in accordance with the print job group, on the basis of the total data size of the print job group and the number of the total Pages of the images to be printed and the like, which are included in the identification information of the tag 1 received from the external device 20A of the user A. Further, the control unit 11 estimates the time required to print the image in accordance with the print job B received from the external device 20B of the user B, on the basis of the data size of the print job B and the like.

When the control unit 11 judges that the time required to print the image in accordance with the print job B is shorter than the remaining time required to print the images in accordance with the above print job group from the estimated time, the control unit 11 instructs the display unit 14 to display the inquiry to determine whether to execute the print of the image in accordance with the print job B by interrupting the execution of the print of the images in accordance with the print job group, as shown in FIG. 10.

When the user B or the like pushes a "Yes" button shown in FIG. 10, the print job B is not masked and the print of the images in accordance with the print job group is interrupted. Then, the image forming apparatus 10 executes the print of the image in accordance with the print job B.

On the other hand, when the user B or the like pushes a "No" button shown in FIG. 10 or when the constant time period elapses since the display contents of FIG. 10 are displayed, the control unit 11 holds the print job B in the RAN or the like. Further, after the print of the images in accordance with the print job group is completed, the control unit 11 controls the image forming unit 13 so as to execute the print of the image in accordance with the print job B.

Thereby, even while the print of the images is executed in accordance with the print job group, it is possible to immediately execute the print of the image in accordance with the print job B which can be executed for the comparatively short time. Further, because the display unit 14 of the image forming apparatus 10 displays the inquiry for the user B or the like to determine whether to execute the print of the image in accordance with the print job B by interrupting the execution of the print of the images in accordance with the print job group, it is possible for the user B or the like to move to the image forming apparatus 10 to execute the print of the image in accordance with the print job B and to receive the printed document quickly. Therefore, the printed documents of one user can be prevented from being mixed with those of another user.

In the above example, the control unit 11 estimates the time required to print the images in accordance with the above print job group, on the basis of the identification information included in the tag 1 received from the external device 20 of the user A, and compares the remaining time required to print the images in accordance with the print job group with the time required to print the image in accordance with the print job B. However, in case that the control unit 11 judges that the time required to print the image in accordance with the print job B is not more than the predetermined threshold value, the control unit 11 may instruct the display unit 14 to display the message for prompting the user B or the like to execute the print of the image in accordance with the print job B by interrupting the execution of the print of the images in accordance with the print job group.

In the above example, the above threshold value is the remaining time required to print the images in accordance with the print job group. However, the threshold value may be also determined as follows. The ratios between the remaining time required to the print the images in accordance with the print job group and the time required to print the image in accordance with the print job B, and the threshold values corresponding to the above ratios are entered in a table. Then, the table is previously stored in the ROM of the control unit 11 or the like and the threshold value is determined by using the stored table. Alternatively, the threshold value may be a fixed value.

Next, the operation in which when the image forming apparatus 10 receives the print job B from the external device 20B of another user during the execution of the print of the images in accordance with the print job group, the display unit 14 which is in the power saving mode, displays the list of the received print jobs, will be explained.

Figure 11:
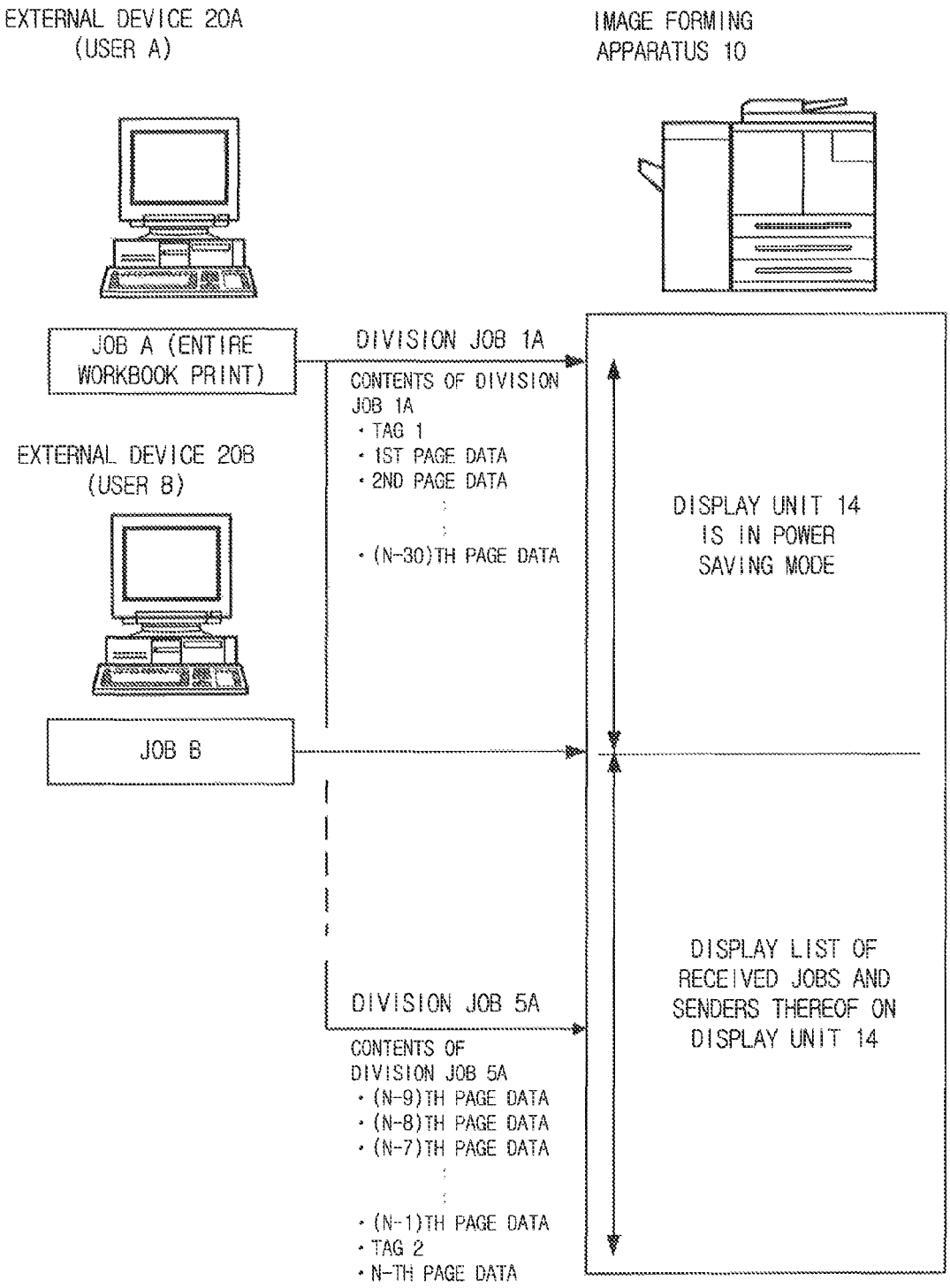
FIG. 11 is an explanatory view which schematically shows the operation for displaying a list of the received print jobs by transferring the mode of the display unit from the power saving mode to the normal mode when the image forming apparatus receives the print job from another user's external device during the execution of the print of the images in accordance with the print job group.

FIG. 11 is an explanatory view which schematically shows the operation for displaying the list of the received print jobs by transferring the mode of the display unit 14 from the power saving mode to the normal mode when the image forming apparatus 10 receives the print job from the external device 20B of another user during the execution of the print of the images in accordance with the print job group.

In the example, the spreadsheet file print job transmitted from the external device 20A of the user A is divided into the division jobs 1A to 5A. The control unit 21 attaches the tag 1 to the initial print job (division job 1A) of a plurality of print jobs and the tag 2 to the last print job (division job 5A), respectively. Further, the image forming apparatus 10 receives the print job B from the external device 20B of the user B since the image forming apparatus 10 executes the print of the image in accordance with the division job 1A until the image forming apparatus 10 receives the division job 5A. Further, the display unit 14 is in the power saving mode until the image forming apparatus 10 receives the print job B. In this example, the power saving mode is a mode for temporarily stopping the display function of the display unit 14 in order to save the power consumption.

When the image forming apparatus 10 receives the print job B from the external device 20B of the user B, the control unit 11 instructs the display unit 14 to return from the power saving mode to the normal mode. That is, the control unit 11 wakes the display unit 14 from the power saving mode. Then, the control unit 11 instructs the display unit 14 to display the print job (any one of the division jobs 1A to 5A) which is currently executed by the image forming unit 13 of the image forming apparatus 10, the print jobs which are temporarily stored in the RAM of the control unit 11 or the like, and the above print job B, as a list. Further, the control unit 11 instructs the display unit 14 to display the users who transmit the displayed print jobs.

When the image forming apparatus 10 of which the display unit 14 is in the power saving mode receives the print jobs from a plurality of external devices 20, the control unit 11 activates the display unit 14 to display the print jobs and the users who transmit the print jobs. Therefore, it is possible for the users to recognize the print job which is currently executed and the user (sender) who transmits the above print job.

Modified Example 1

In the above embodiment, the case in which the external device 20 attaches the tag 1 to the initial print job of a plurality of print jobs (print job group) which are generated by dividing the spreadsheet file print, job, and the tag 2 to the last print job, respectively, is explained. In the modified example 1, the case in which the external device 20 does not attach the tag to the above initial print job and attaches the tag to the above last print job, will be explained.

Figure 12:
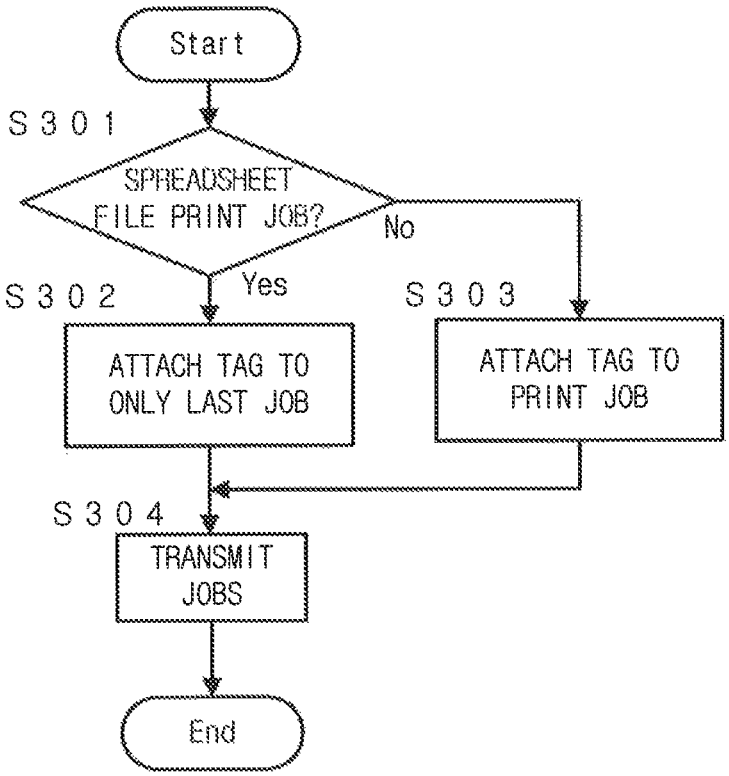
FIG. 12 is a flowchart showing the process in which the external device attaches a tag having identification information to a last print job of the print job group according to the modified example 1.
Figure 13:
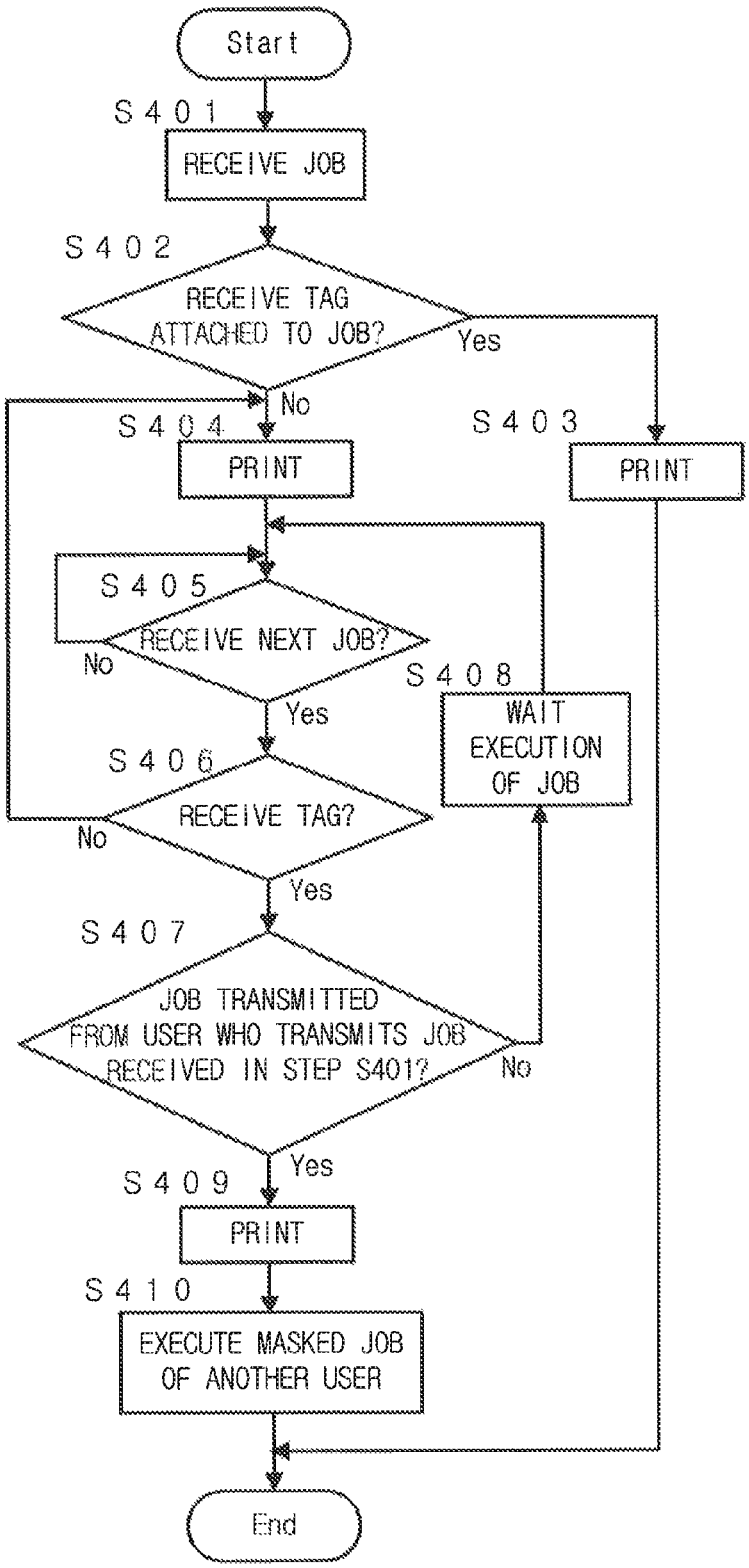
FIG. 13 is a flowchart showing the process in which the image forming apparatus identifies the received print job and in case that the image forming apparatus identifies that the received print job is a print job received from another external device, the image forming apparatus waits the execution of the received print job until the image forming apparatus completes the print of images in accordance with the print job group, according to the modified example 1.

FIG. 12 is a flowchart showing the process in which the external device 20 attaches the tag having the identification information to the last print job of the print job group according to the modified example 1. FIG. 13 is a flowchart showing the operation of the image forming apparatus 10 which receives the print job according to the modified example 1.

The control unit 21 of the external device 20 judges whether the print job to be transmitted to the image forming apparatus 10 is the spreadsheet file print job or not (Step S301).

In case that the control unit 21 judges that the print job to be transmitted is the spreadsheet file print job (Step S301; Yes), the control unit 21 attaches the tag having the identification information to only the print job to be transmitted last in the print job group when the print job group is generated by dividing the spreadsheet file print job (Step S302).

As the identification information of the tag, the information relating to the user who transmits the print job group for example, the user information and the IP address of the external device 20) and the information indicating that the print job to which the tag is attached is the last print job of the print job group, are included.

On the other hand, in case that the control unit 21 judges that the print job to be transmitted is not the spreadsheet file print job (Step S301; No), the control unit 21 attaches the tag having the identification information to this print job (Step S303).

As the identification information of this tag, the information relating to the user who transmits this print job and the information indicating that this print job to which this tag is attached is a print job which is not a division job of the print job group, are included.

Then, the control unit 21 transmits the print job to the image forming apparatus 10 via the network I/F unit 25 (Step S304). The operation of the external device 20 is ended.

The image forming apparatus 10 receives the print job transmitted from the external device 20 (Step S401).

When the image forming apparatus 10 receives the print job from the external device 20 via the network I/F unit 16, the control unit 11 judges whether the tag is attached to the received print job, that is, whether the tag is received (Step S402).

In case that the control unit 11 judges that the image forming apparatus 10 receives the tag (Step S402; Yes), the control unit 11 judges that the received print job is not the print job (division job) of the print job group generated by dividing the spreadsheet file print job. The image forming unit 13 executes the print of the image in accordance with the received print job (Step S403). Then, the operation of the image forming apparatus 10 is ended.

On the other hand, in case that the control unit 11 judges that the image forming apparatus 10 does not receive the tag (Step S402; No), the image forming unit 13 executes the print of the image in accordance with the received print job (Step S404). At this time, the control unit 11 judges that the received print job is the division job. Then, the control unit 11 monitors the reception of the next print job (Step S405; No).

When the control unit 11 judges that image forming apparatus 10 receives the next print job (Step S405; Yes), the control unit 11 judges whether the tag is attached to the received print job, that is, whether the tag is received (Step S406).

When the control unit 11 judges that the tag is not attached to the received print job (Step S406; No), the process returns to Step S404 and the image forming unit 13 executes the print of the image in accordance with the received print job. At this time, the control unit 11 judges that the received print job is the division job but is not the last division job, and monitors the reception of the next print job (Step S405; No).

On the other hand, when the control unit 11 judges that the tag is attached to the received print job (Step S406; Yes), the control unit 11 judges whether the user (external device 20) who transmits the print job to which the tag is attached is the same as the user (external device 20) who transmits the print job (division job) received in Step S401, to which the tag is not attached, in accordance with the user information and the IP address of the external device 20 and the like, which are included in the accessory information of the received print jobs (Step S407).

When the control unit 11 judges that the user who transmits the print job to which the tag is attached is not the same as the user who transmits the print job (division job) received in Step S401, to which the tag is not attached (Step S407; No), the control unit 11 judges that the received print job is not the division job and waits the execution of the received print job by temporarily holding the received print job in the RAM of the control unit 11 or the HDD 12, for example by masking the received print job (Step S408). Then, the control unit 11 monitors the reception of the next print job again (Step S405; No).

On the other hand, when the control unit 11 judges that the user who transmits the print job to which the tag is attached is the same as the user who transmits the print job (division job) received in Step S401, to which the tag is not attached (Step S407; Yes), the control unit 11 judges that the received print job is the last division job of the print job group. Then, the image forming unit 13 prints the image in accordance with the received print job (Step S409).

After the image forming unit 13 prints the image in accordance with the last division job, the control unit 11 executes the print job received from another user, which is held in the RAM of the control unit 11 or the like, for example, by masking the print job (Step S410). Then, the operation of the image forming apparatus 10 is ended.

Modified Example 2

In the modified example 1, the case in which the tag is attached to the last print job of the print job group, is explained. In the modified example 2, the case in which the tag is attached to the initial print job of the print job group, will be explained.

Figure 14:
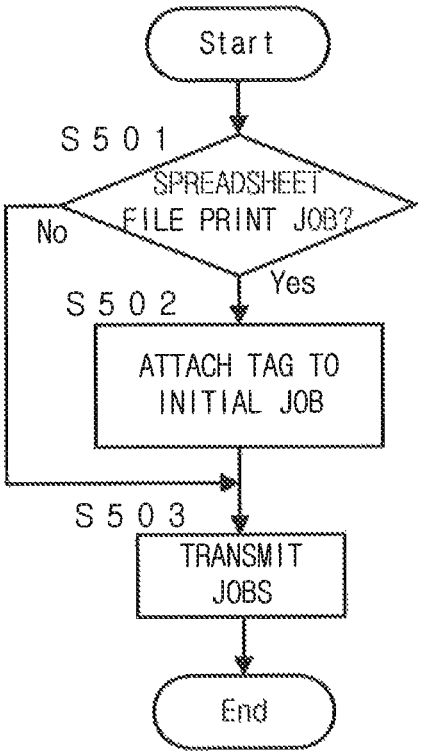
FIG. 14 is a flowchart showing the process in which the external device attaches a tag having identification information to the initial print job of the print job group according to the modified example 2.
Figure 15:
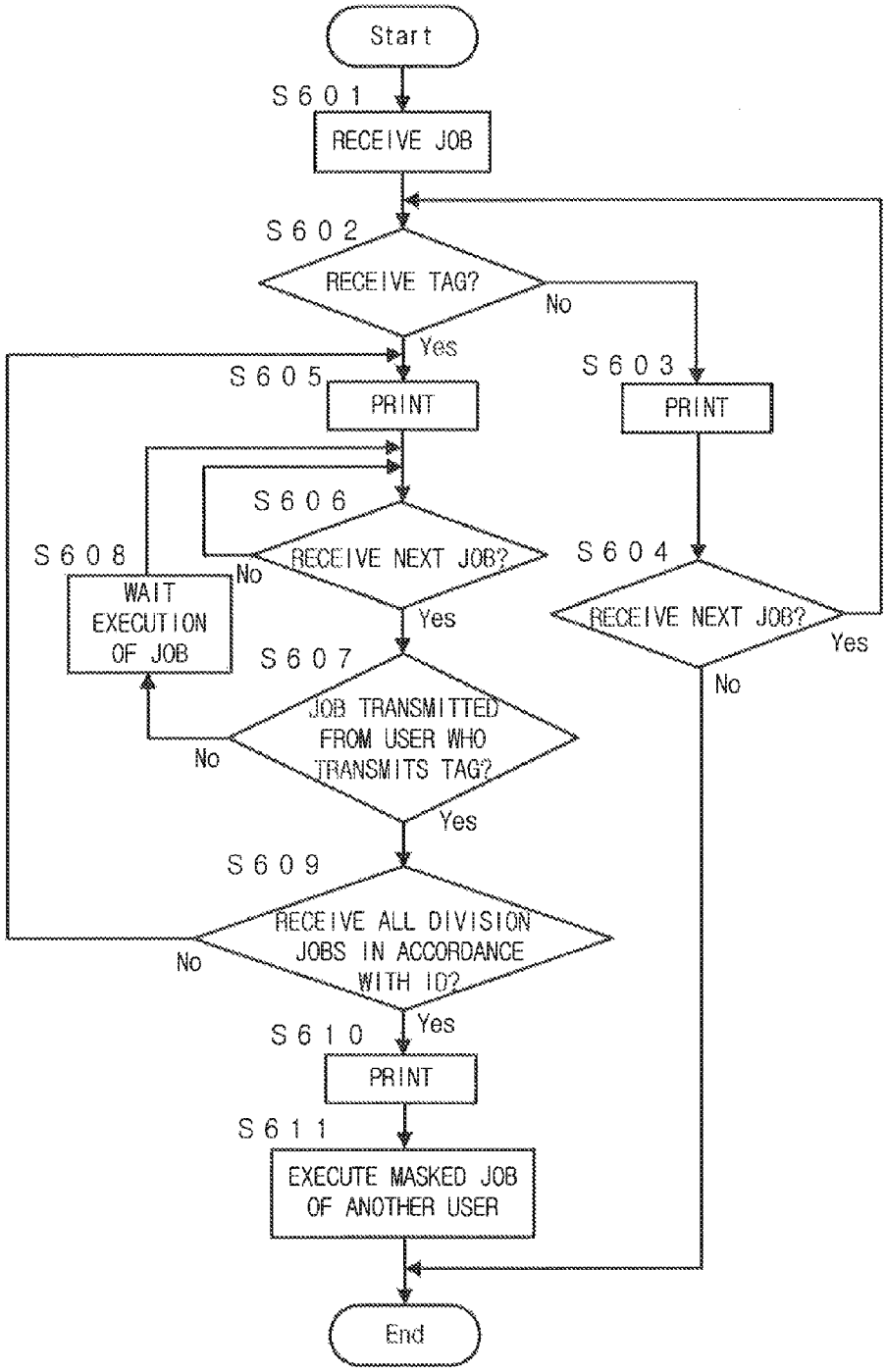
FIG. 15 is a flowchart showing the process in which the image forming apparatus identifies the received print job and in case that the image forming apparatus identifies that the received print job is a print job received from another external device, the image forming apparatus waits the execution of the received print job until the image forming apparatus completes the print of images in accordance with the print job group, according to the modified example 2.

FIG. 14 is a flowchart showing the process in which the external device 20 attaches the tag having the identification information to the initial print job of the print job group according to the modified example 2. FIG. 15 is a flowchart showing the operation of the image forming apparatus 10 which receives the print job according to the modified example 2.

The control unit 21 of the external device 20 judges whether the print job to be transmitted to the image forming apparatus 10 is the spreadsheet file print job or not (Step S501).

In case that the control unit 21 judges that the print job to be transmitted is the spreadsheet file print job (Step S501; Yes), the control unit 21 attaches the tag haying the identification information to only the print job to be initially transmitted in the print job group when the print, job group is generated by dividing the spreadsheet file print job (Step S502).

In this tag, as the identification information, the information relating to the user (sender) who transmits the print job group to the image forming apparatus 10, the number of the division jobs constituting the print, job group, the total data size of the print job group, the number of the total pages of the image data included in the print job group, are included.

Then, the control unit 21 transmits the print job group to the image forming apparatus 10 via the network I/F unit 25 (Step S503). The operation of the external device 20 is ended.

On the other hand, in case that the control unit 21 judges that the print job to be transmitted is not the spreadsheet file print job (Step S501; No), the control unit 21 transmits the print job to the image forming apparatus 10 via the network I/F unit 25 without attaching the tag to the print job (Step S503). The operation of the external device 20 is ended.

The image forming apparatus 10 receives the print job transmitted from the external device 20 (Step S601).

When the image forming apparatus 10 receives the print job from the external device 20 via the network I/F unit 16, the control unit 11 judges whether the tag is attached to the received print job, that is, whether the tag is received (Step S602).

In case that the control unit 11 judges that the image forming apparatus 10 does not receive the tag (Step S602; No), the image forming unit 13 executes the print of the image in accordance with the received print job (Step S603). At this time, the control unit 11 judges that the received print job is not the division job. Then, the control unit 11 judges whether the next print job is received or not (Step S604). When the control unit 11 judges that the next print job is not received (Step S604; No), the operation of the image forming apparatus 10 is ended. On the other hand, when the control unit 11 judges that the next print job is received (Step S604; Yes), the process returns to Step S602.

In case that the control unit 11 judges that the image forming apparatus 10 receives the tag (Step S602; Yes), the image forming unit 13 executes the print of the image in accordance with the received print job (Step S605). At this time, the control unit 11 judges that the received print job is the initial job of the print job group. Then, the control unit 11 monitors the reception of the next print job (Step S606; No).

When the control unit 11 judges that image forming apparatus 10 receives the next print job (Step S606; Yes), the control unit 11 judges whether the user (external device 20) who transmits this received print job is the same as the user (external device 20) who transmits the above print job group, in accordance with the user information of the external device 20 which transmits the above print, job group and the user information and the IP address of the external device 20 which transmits this received print job and the like (Step S607). The user information of the external device 20 which transmits the above print job group is included in the identification information of the tag. The user information and the IP address of the external device 20 which transmits this received print job are included in the accessory information of the received print jobs.

When the control unit 11 judges whether the user who transmits this received print job is not the same as the user who transmits the above print job group (Step S607; No), the control unit 11 judges that the received print, job is not the division job and waits the execution of the received print job by temporarily holding the received print job in the RAN of the control unit 11 or the HDD 12, for example, by masking the received print job (Step S608). Then, the control unit 11 monitors the reception of the next print job again (Step S606; No).

On the other hand, when the control unit 11 judges that the user who transmits this received print job is the same as the user who transmits the above print job group (Step S607; Yes), the control unit 11 judges that the received print job is the division job. Then, the control unit 11 judges whether the image forming apparatus 10 receives all of the division jobs in accordance with the number of the division jobs constituting the print job group, the total data size of the print job group, the number of the total pages of the image data included in the print job group or the like, which is included in the identification information of the tag (Step S609).

When the control unit 11 judges that the image forming apparatus 10 does not receive all of the division jobs, that is, the image forming apparatus 10 does not receive the last division job (Step S609; No), the image forming unit 13 prints the image in accordance with the received print job (Step S605). Then, the control unit 11 monitors the reception of the next print job again (Step S606; No).

When the control unit 11 judges that the image forming apparatus 10 receives all of the division jobs (Step S609; Yes), the image forming unit 13 prints the image in accordance with the received print job (Step S610). After the image forming unit 13 prints the images in accordance with the last division job, the control unit 11 executes another print job received from another user, which is held in the RAN of the control unit 11 or the like, for example, by masking the print job (Step S611). Then, the operation of the image forming apparatus 10 is ended.

As described above, the embodiment is explained by using the drawings. However, in the present invention, the concrete configuration is not limited to the above embodiment. In the present invention, various modifications of the above embodiment or the addition of various functions or the like to the embodiment can be carried out without departing from the gist of the invention.

In the embodiment, the case in which the external device 20 attaches the tag 1 to the initial division job of the print job group and the tag 2 to the last division job respectively, is explained. In the modified examples, the case in which the tag is attached to the initial division job or the last division job is explained. However, the present invention is not limited to these examples. As long as the control unit 11 of the image forming apparatus 10 can identify whether the received print job is the division job or not, the division job to which the tag is attached can be optionally determined. In this case, as the identification information, the information relating to the user who transmits the print job group to the image forming apparatus (the user information and the IP address of the external device 20), the number of the print jobs (division jobs) constituting the print job group, the total data size of the print job group, the number of the total pages of the image data included in the print job group and the like may be used by suitably combining them.

For example, the external device 20 can attach the tag to the division jobs except the last division job of a plurality of division jobs. In this case, when the image forming apparatus 10 receives the job to which the tag is attached, the control unit 11 identifies the job which is the division job but is not the last division job. In case that the job following the job to which the above tag is attached does not have the tag, the image forming apparatus 10 judges whether the user (external device 20) who transmits the job to which the above tag is attached is the same as the user (external device 20) who transmits the job which does not have the tag. When the control unit 11 judges that the above users are the same, the control unit 11 judges that the job which does not have the above tag is the last division job. On the other hand, when the control unit 11 judges that the above users are not the same, the control unit 11 judges that the job which does not have the above tag is the job which is transmitted from another user, that is, the job is not the division job.

In the embodiment and the modified examples, the case in which the job to be transmitted from the external device 20 is the spreadsheet file print job, is explained. If the image forming apparatus 10 receives the print job group generated by dividing the job into a plurality of job despite the user's intention, the present invention can be applied.

One of the objects of the above embodiment is to provide an image forming system and an image forming apparatus, which can prevent the printed document of one user from being mixed with that of another user even though the print job of one user is divided into a plurality of jobs despite the user's intention and the print job of another user is inserted into the plurality of jobs.

In the above embodiment and the like, in case that the print job to be transmitted is a print job of the print job group having two or more division jobs generated by dividing one print job, the external device attaches the tag having the identification information to the print job group. On the other hand, the image forming apparatus identifies whether the print job received while the print job group is received is the division job of the print job group or another print, job received from another external device in accordance with the identification information included in the tag attached to the print job group received from one external device. In case that the image forming apparatus recognizes that the received print job is another print job received from another external device, the image forming apparatus waits the execution of another print job while the image forming is executed in accordance with the print job group.

Therefore, even though the print job is divided into a plurality of jobs despite the user's intention and another print job of another user is inserted into the division jobs, it is possible to prevent the printed document of one user from being mixed with that of another user.

In the above embodiment and the like, as the identification information of the tag, for example, the information relating to the user who transmits the print job group to the image forming apparatus, is included. Further, in the identification information of the first tag, the information indicating that the print job to which this tag is attached is the initial division job of the print job group, is included. In the identification information of the second tag, the information indicating that the print job to which this tag is attached is the last division job of the print job group, is included. Thereby, it is possible to identify the print job which is arranged between the first tag and the second tag and which is transmitted by the same user as the user who transmits the print job to which the first tag is attached, as the division job of the above print job group.

In the above embodiment and the like, it is possible to identify whether the print job received by the image forming apparatus is the division job of the print job group received from the external device in accordance with the identification information.

In the above embodiment and the like, in the identification information of the tag which is attached to the last division job, for example, the information indicating that the print job to which the tag is attached is the last division job of the print job group, is included. Further, another tag is attached to a print job except the division job and indicates that this print job is not the division job. Because the print job having the tag is the last division job or a normal print job, it is possible to judge that the following division job is not transmitted. On the other hand, it is possible to judge that the print job having no tag is the division job of the print job group except the last division job, and to recognize that the following division job will be transmitted. Therefore, it is possible to identify whether the print job received by the image forming apparatus is the division job of the print job group.

In the above embodiment and the like, in case that the images of a plurality of pages are formed on one sheet, the image forming unit waits the execution of the image forming on one sheet until the job reception unit receives the image data of the plurality of pages. Thereby, it is possible to prevent the images from being formed on the sheet in the state that all of the image data of a plurality of pages, for forming the images on one sheet are not received and the received image data is lacking.

In the above embodiment and the like, the control unit estimates the receiving time required to receive the print job group in accordance with the receiving time estimation information included in the identification information of the tag, and determines the timing at which the image forming unit starts the image forming of an initial page, based on the estimated receiving time. Thereby, for example, it is possible to determine the timing to start the image forming of the initial page so as to complete the image forming in accordance with the print job group at the substantially same timing as the timing of completing the reception of the print job group. As a result, it is possible to shorten the time for occupying the image forming apparatus to print the images in accordance with the above print job group. Therefore, even in case that the image forming apparatus receives another print job while the image forming apparatus receives the print job group, it is possible to preferentially execute the image forming in accordance with another print job without waiting until the image forming is completed in accordance with the above print job group, if the image forming apparatus receives another print job before the timing of starting the image forming of the initial page, which is determined in accordance with the estimated receiving time and the timing at which the image forming executed in accordance with another print job is completed is earlier than the above timing of starting the image forming of the initial page. Further, because the actuating time of the image forming unit of the image forming apparatus is shortened, it is possible to contribute the power saving.

The receiving time estimation information may be the information for estimating the receiving time for receiving the print job group, such as the number of the division jobs of the print job group, the total data size of the print job group, or the like.

In the above embodiment and the like, when another print job is received while the image forming unit executes the image forming in accordance with the print job group, the image forming apparatus inquires whether to execute the image forming in accordance with another print job by interrupting the image forming executed in accordance with the print job group. Thereby, it is possible to immediately execute the image forming in accordance with another print job by interrupting the image forming executed in accordance with the print, job group. Further, because the user can instruct the image forming apparatus to intentionally execute the image forming in accordance with another print, job during the execution of the image forming in accordance with the print job group, it is possible to quickly receive the printed document obtained by the image forming in accordance with another print job. Therefore, it is possible to prevent the printed, document of one user from being mixed with that of another user.

In the above embodiment and the like, in particular, in case that the time required to execute the image forming in accordance with another print job is short, the image forming apparatus inquires whether to execute the image forming in accordance with another print job by interrupting the image forming executed in accordance with the print job group.

In the above embodiment and the like, in case that the display unit is in a power saving mode, when the job reception unit receives another print job while the image forming unit executes the image forming in accordance with the print job group, the control unit wakes the display unit from the power saving mode to display the user who transmits the print jobs. The power saving mode is a mode for temporarily stopping the display function of the display unit in order to save the power consumption.

According to the image forming system and the image forming apparatus, it is possible to prevent the printed document of one user from being mixed with that of another user even though the print job of one user is divided into a plurality of jobs despite the user's intention and the print job of another user is inserted into the plurality of jobs.

What is claimed is:

1. An image forming system comprising:

an image forming apparatus; and an external device to transmit a print job to the image forming apparatus, the image forming apparatus executing image forming in accordance with the print job;

wherein the external device comprises (i) a tag attaching unit to attach a tag having identification information to a print job group having at least two division jobs generated by dividing one print job in case that the print job to be transmitted is the print job group, the identification information requesting the image forming apparatus which receives the division jobs constituting the print job group to identify that the transmitted print job is the division job, and (ii) a job transmission unit to transmit the print job group;

wherein the image forming apparatus comprises (i) a control unit, (ii) an image forming unit to execute the image forming in accordance with the print job group, (iii) a storing unit to hold one or more print jobs, and (iv) a job reception unit to receive the print job group from the external device;

wherein the job reception unit receives the tag, and in case that in accordance with the identification information included in the tag the control unit identifies that the print job received while the job reception unit receives the print job group is another print job received from another external device except the external device which transmits the print job group, the control unit controls the storing unit so as to hold the another print job until the image forming unit completes the image forming in accordance with the print job group, and after the image forming unit completes the image forming in accordance with the print job group, the control unit controls the image forming unit to start the image forming in accordance with the another print job; and wherein the tag is attached to a last division job which is received by the job reception unit last in the print job group, and the tag attaching unit attaches another tag having another identification information to a print job except the division job, the another identification information requesting the image forming apparatus to identify that the print job except the division job is not the division job.

2. The image forming system of claim 1, further comprising a display unit, wherein when the job reception unit receives the another print job while the image forming unit executes the image forming in accordance with the print job group, the control unit instructs the display unit to display an inquiry to determine whether to execute the image forming in accordance with the another print job by interrupting the image forming executed in accordance with the print job group during execution of the image forming in accordance with the print job group.

3. The image forming system of claim 2, wherein the control unit estimates a time required to execute the image forming in accordance with the another print job, and when the control unit judges that the estimated time is not more than a threshold value, the control unit instructs the display unit to display the inquiry to determine whether to execute the image forming in accordance with the another print job by interrupting the image forming executed in accordance with the print job group.

4. The image forming system of claim 2, wherein in case that the display unit is in a power saving mode when the job reception unit receives the another print job while the image forming unit executes the image forming in accordance with the print job group, the control unit wakes the display unit from the power saving mode and instructs the display unit to display information relating to the print jobs which are received by the job reception unit.

5. An image forming system comprising:

an image forming apparatus; and an external device to transmit a print job to the image forming apparatus, the image forming apparatus executing image forming in accordance with the print job;

wherein the external device comprises (i) a tag attaching unit to attach a tag having identification information to a print job group having at least two division jobs generated by dividing one print job in case that the print job to be transmitted is the print job group, the identification information requesting the image forming apparatus which receives the division jobs constituting the print job group to identify that the transmitted print job is the division job, and (ii) a job transmission unit to transmit the print job group;

wherein the image forming apparatus comprises (i) a control unit, (ii) an image forming unit to execute the image forming in accordance with the print job group, (iii) a storing unit to hold one or more print jobs, and (iv) a job reception unit to receive the print job group from the external device;

wherein the job reception unit receives the tag, and in case that in accordance with the identification information included in the tag the control unit identifies that the print job received while the job reception unit receives the print job group is another print job received from another external device except the external device which transmits the print job group, the control unit controls the storing unit so as to hold the another print job until the image forming unit completes the image forming in accordance with the print job group, and after the image forming unit completes the image forming in accordance with the print job group, the control unit controls the image forming unit to start the image forming in accordance with the another print job; and wherein, in case that the job reception unit receives the print job group for forming images of a plurality of pages on one sheet from the external device, the control unit controls the image forming unit to start the image forming on the one sheet after the job reception unit receives image data of the plurality of pages for forming the images of the plurality of pages on the one sheet.

6. The image forming system of claim 5, further comprising a display unit, wherein when the job reception unit receives the another print job while the image forming unit executes the image forming in accordance with the print job group, the control unit instructs the display unit to display an inquiry to determine whether to execute the image forming in accordance with the another print job by interrupting the image forming executed in accordance with the print job group during execution of the image forming in accordance with the print job group.

7. The image forming system of claim 6, wherein the control unit estimates a time required to execute the image forming in accordance with the another print job, and when the control unit judges that the estimated time is not more than a threshold value, the control unit instructs the display unit to display the inquiry to determine whether to execute the image forming in accordance with the another print job by interrupting the image forming executed in accordance with the print job group.

8. The image forming system of claim 6, wherein in case that the display unit is in a power saving mode when the job reception unit receives the another print job while the image forming unit executes the image forming in accordance with the print job group, the control unit wakes the display unit from the power saving mode and instructs the display unit to display information relating to the print jobs which are received by the job reception unit.

9. An image forming system comprising:

a display unit;

an image forming apparatus; and an external device to transmit a print job to the image forming apparatus, the image forming apparatus executing image forming in accordance with the print job;

wherein the external device comprises (i) a tag attaching unit to attach a tag having identification information to a print job group having at least two division jobs generated by dividing one print job in case that the print job to be transmitted is the print job group, the identification information requesting the image forming apparatus which receives the division jobs constituting the print job group to identify that the transmitted print job is the division job, and (ii) a job transmission unit to transmit the print job group;

wherein the image forming apparatus comprises (i) a control unit, (ii) an image forming unit to execute the image forming in accordance with the print job group, (iii) a storing unit to hold one or more print jobs, and (iv) a job reception unit to receive the print job group from the external device;

wherein the job reception unit receives the tag, and in case that in accordance with the identification information included in the tag the control unit identifies that the print job received while the job reception unit receives the print job group is another print job received from another external device except the external device which transmits the print job group, the control unit controls the storing unit so as to hold the another print job until the image forming unit completes the image forming in accordance with the print job group, and after the image forming unit completes the image forming in accordance with the print job group, the control unit controls the image forming unit to start the image forming in accordance with the another print job;

wherein, when the job reception unit receives the another print job while the image forming unit executes the image forming in accordance with the print job group, the control unit instructs the display unit to display an inquiry to determine whether to execute the image forming in accordance with the another print job by interrupting the image forming executed in accordance with the print job group during execution of the image forming in accordance with the print job group; and wherein the control unit estimates a time required to execute the image forming in accordance with the another print job, and when the control unit judges that the estimated time is not more than a threshold value, the control unit instructs the display unit to display the inquiry to determine whether to execute the image forming in accordance with the another print job by interrupting the image forming executed in accordance with the print job group.

10. The image forming system of claim 9, wherein in case that the display unit is in a power saving mode when the job reception unit receives the another print job while the image forming unit executes the image forming in accordance with the print job group, the control unit wakes the display unit from the power saving mode and instructs the display unit to display information relating to the print jobs which are received by the job reception unit.

11. An image forming apparatus comprising:

a control unit;

an image forming unit to execute image forming in accordance with a print job;

a storing unit to hold one or more print jobs; and a job reception unit to receive a print job group having two or more division jobs generated by dividing one print job, from one external device;

wherein the job reception unit receives a tag which is attached to the print job group and which has identification information for identifying whether the print job received by the job reception unit is the division job;

wherein, in case that in accordance with the identification information the control unit identifies that the print job received while the job reception unit receives the print job group is another print job received from another external device, the control unit controls the storing unit so as to hold the another print job until the image forming unit completes the image forming in accordance with the print job group, and after the image forming unit completes the image forming in accordance with the print job group, the control unit controls the image forming unit to start the image forming in accordance with the another print job; and wherein, in case that the job reception unit receives the print job group for forming images of a plurality of pages on one sheet, from the one external device, the control unit controls the image forming unit to start the image forming on the one sheet after the job reception unit receives image data of the plurality of pages for forming the images of the plurality of pages on the one sheet.

12. The image forming apparatus of claim 11, further comprising a display unit, wherein when the job reception unit receives the another print job while the image forming unit executes the image forming in accordance with the print job group, the control unit instructs the display unit to display an inquiry to determine whether to execute the image forming in accordance with the another print job by interrupting the image forming executed in accordance with the print job group during execution of the image forming in accordance with the print job group.

13. The image forming apparatus of claim 12, wherein the control unit estimates a time required to execute the image forming in accordance with the another print job, and when the control unit judges that the estimated time is not more than a threshold value, the control unit instructs the display unit to display the inquiry to determine whether to execute the image forming in accordance with the another print job by interrupting the image forming executed in accordance with the print job group.

14. The image forming apparatus of claim 12, wherein in case that the display unit is in a power saving mode when the job reception unit receives the another print job while the image forming unit executes the image forming in accordance with the print job group, the control unit wakes the display unit from the power saving mode and instructs the display unit to display information relating to the print jobs which are received by the job reception unit.

15. An image forming apparatus comprising:

a display unit;

a control unit;

an image forming unit to execute image forming in accordance with a print job;

a storing unit to hold one or more print jobs; and a job reception unit to receive a print job group having two or more division jobs generated by dividing one print job, from one external device;

wherein the job reception unit receives a tag which is attached to the print job group and which has identification information for identifying whether the print job received by the job reception unit is the division job;

wherein, in case that in accordance with the identification information the control unit identifies that the print job received while the job reception unit receives the print job group is another print job received from another external device, the control unit controls the storing unit so as to hold the another print job until the image forming unit completes the image forming in accordance with the print job group, and after the image forming unit completes the image forming in accordance with the print job group, the control unit controls the image forming unit to start the image forming in accordance with the another print job;

wherein, when the job reception unit receives the another print job while the image forming unit executes the image forming in accordance with the print job group, the control unit instructs the display unit to display an inquiry to determine whether to execute the image forming in accordance with the another print job by interrupting the image forming executed in accordance with the print job group during execution of the image forming in accordance with the print job group; and wherein the control unit estimates a time required to execute the image forming in accordance with the another print job, and when the control unit judges that the estimated time is not more than a threshold value, the control unit instructs the display unit to display the inquiry to determine whether to execute the image forming in accordance with the another print job by interrupting the image forming executed in accordance with the print job group.

16. The image forming apparatus of claim 15, wherein in case that the display unit is in a power saving mode when the job reception unit receives the another print job while the image forming unit executes the image forming in accordance with the print job group, the control unit wakes the display unit from the power saving mode and instructs the display unit to display information relating to the print jobs which are received by the job reception unit.

* * * * *